US011713530B2

(12) United States Patent
Farrington et al.

(10) Patent No.: US 11,713,530 B2
(45) **Date of Patent: *Aug. 1, 2023**

(54) EXTENDED TUB FOR A LAUNDRY TREATING APPLIANCE

(71) Applicant: WHIRLPOOL CORPORATION, Benton Harbor, MI (US)

(72) Inventors: Eric K. Farrington, Stevensville, MI (US); Karl David Mcallister, Stevensville, MI (US); Brenner M. Sharp, Bridgman, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 41 days.

This patent is subject to a terminal disclaimer.

(21) Appl. No.: 17/201,013

(22) Filed: Mar. 15, 2021

(65) Prior Publication Data

US 2021/0198831 A1 Jul. 1, 2021

Related U.S. Application Data

(63) Continuation of application No. 16/234,957, filed on Dec. 28, 2018, now Pat. No. 10,988,885.

(51) Int. Cl.

| | |
|---|---|
| ***D06F 37/26*** | (2006.01) |
| ***D06F 37/12*** | (2006.01) |
| ***D06F 37/30*** | (2020.01) |
| ***D06F 21/08*** | (2006.01) |
| ***D06F 39/02*** | (2006.01) |
| ***D06F 37/40*** | (2006.01) |
| ***D06F 39/08*** | (2006.01) |

(52) U.S. Cl.
CPC ..... *D06F 37/26* (2013.01); *D06F 21/08* (2013.01); *D06F 37/12* (2013.01); *D06F 37/264* (2013.01); *D06F 37/30* (2013.01); *D06F 37/40* (2013.01); *D06F 39/02* (2013.01); *D06F 39/083* (2013.01)

(58) Field of Classification Search
CPC .... D06F 37/206; D06F 37/267; D06F 37/264; D06F 37/30; D06F 37/20; D06F 37/22–245; D06F 37/40; D06F 37/262; D06F 37/26; D06F 37/308; D06F 37/304
See application file for complete search history.

(56) References Cited

U.S. PATENT DOCUMENTS 4,969,341 A 11/1990 Burk et al.
6,116,061 A 9/2000 Oh et al.
(Continued)

FOREIGN PATENT DOCUMENTS

KR 20010000429 U * 1/2001
KR 20010000429 U 1/2001
(Continued)

*Primary Examiner* — Spencer E. Bell
*Assistant Examiner* — Omair Chaudhri
(74) *Attorney, Agent, or Firm* — McGarry Bair PC

(57) ABSTRACT

A laundry treating appliance having a rotatable basket that defines a treating chamber, a tub for mounting the rotatable basket, a drive assembly mounted to the tub for rotating the basket and a drive motor mounted to the tub for driving the drive assembly. The tub has a lower region comprising a central cavity and a second cavity. The drive assembly is nested in the central cavity and the drive motor is nested in the second cavity for reducing the vertical stack of tub and the motor.

17 Claims, 4 Drawing Sheets

(56) References Cited

U.S. PATENT DOCUMENTS

| | | | | |
|---|---|---|---|---|
| 9,388,524 | B2 | 7/2016 | Cho et al. | |
| 9,481,958 | B2 | 11/2016 | Park | |
| 11,174,585 | B2 * | 11/2021 | Lee | D06F 37/04 |
| 2006/0236729 | A1 * | 10/2006 | Hollenhorst | D06F 37/264 68/237 |
| 2008/0060389 | A1 * | 3/2008 | Blomberg | D06F 37/264 68/208 |
| 2012/0222454 | A1 * | 9/2012 | Park | D06F 37/30 68/133 |
| 2013/0255328 | A1 * | 10/2013 | Quandt | D06F 37/264 29/428 |
| 2017/0152621 | A1 * | 6/2017 | Erickson | B29C 49/06 |
| 2018/0327957 | A1 * | 11/2018 | Kim | D06F 37/26 |

FOREIGN PATENT DOCUMENTS

| | | | |
|---|---|---|---|
| KR | 20130048758 | A | 5/2013 |
| KR | 101674527 | B1 | 11/2016 |

* cited by examiner

EXTENDED TUB FOR A LAUNDRY TREATING APPLIANCE

CROSS-REFERENCE TO RELATED APPLICATIONS

The present application is a continuation application of U.S. patent application Ser. No. 16/234,957, filed on Dec. 28, 2018, now U.S. Pat. No. 10,988,885, issued Apr. 27, 2021, which is hereby incorporated herein by reference.

BACKGROUND

Laundry treating appliances, such as clothes washers, refreshers, and non-aqueous systems, can have a configuration based on a rotating laundry basket that defines a treating chamber in which laundry items are placed for treating. Laundry baskets are typically housed in a laundry tub and driven by a motor and drive assembly.

BRIEF SUMMARY

The present disclosure relates to a laundry treating appliance that has a rotatable basket that defines a treating chamber, a tub for mounting the rotatable basket, a drive assembly mounted to the tub for rotating the basket and a drive motor mounted to the tub for driving the drive assembly. The tub has a lower region comprising a non-symmetrical plurality of circular rims and radial ribs that define a central cavity about a first circular rim and a second cavity spaced from the central cavity. At least two of the plurality of radial ribs extend from the first circular rim at a first angle until a distance between the ribs is greater than a diameter of the drive motor. Each of the at least two of the plurality of radial ribs transitions at a second angle for a length to accommodate the diameter of the drive motor and each of the at least two of the plurality of radial ribs further transitioning at a third angle for a length to form second cavity around the drive motor. The drive assembly is nested in the central cavity and the drive motor is nested adjacent the second cavity such that at least a portion of a height of the at least one of the plurality of circular rims extends a length of the drive motor for reducing a vertical stack of the tub and the motor.

DESCRIPTION

Figure 1:
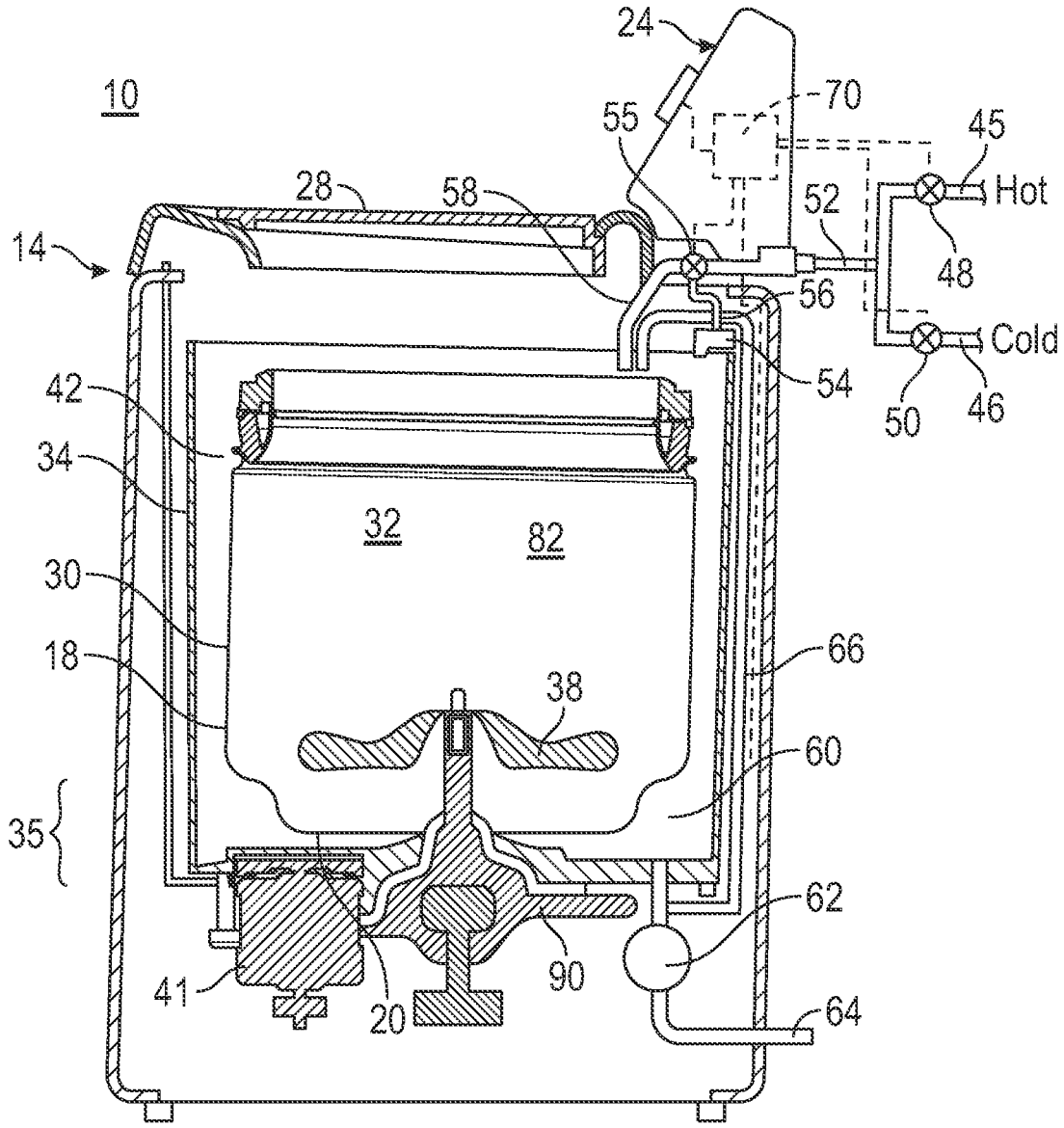
FIG. 1 is a schematic view of an exemplary laundry treating appliance in the form of a washing machine.
Figure 2:
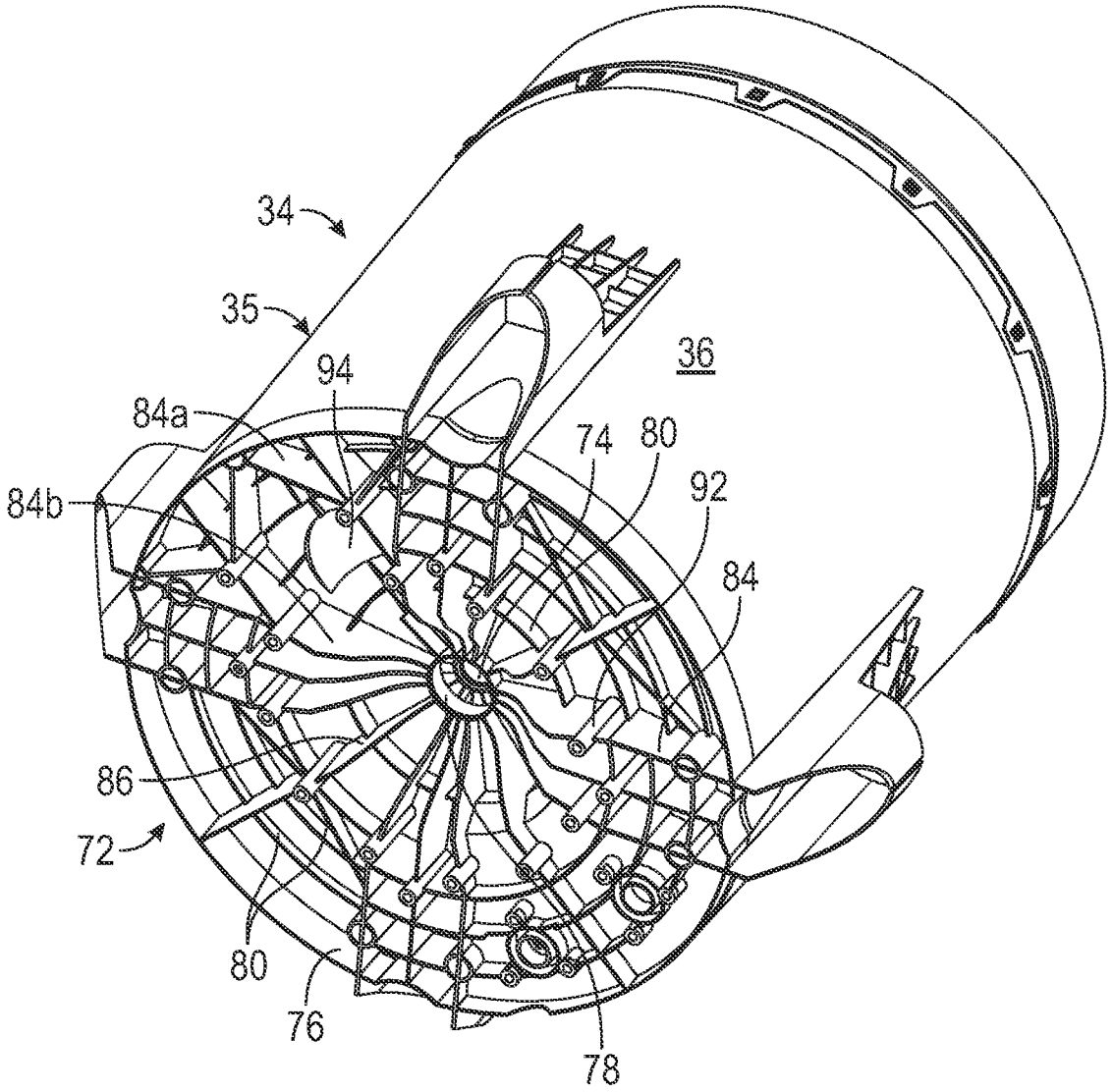
FIG. 2 is a perspective bottom view of a tub that can be utilized in the laundry treating appliance of FIG. 1.
Figure 3:
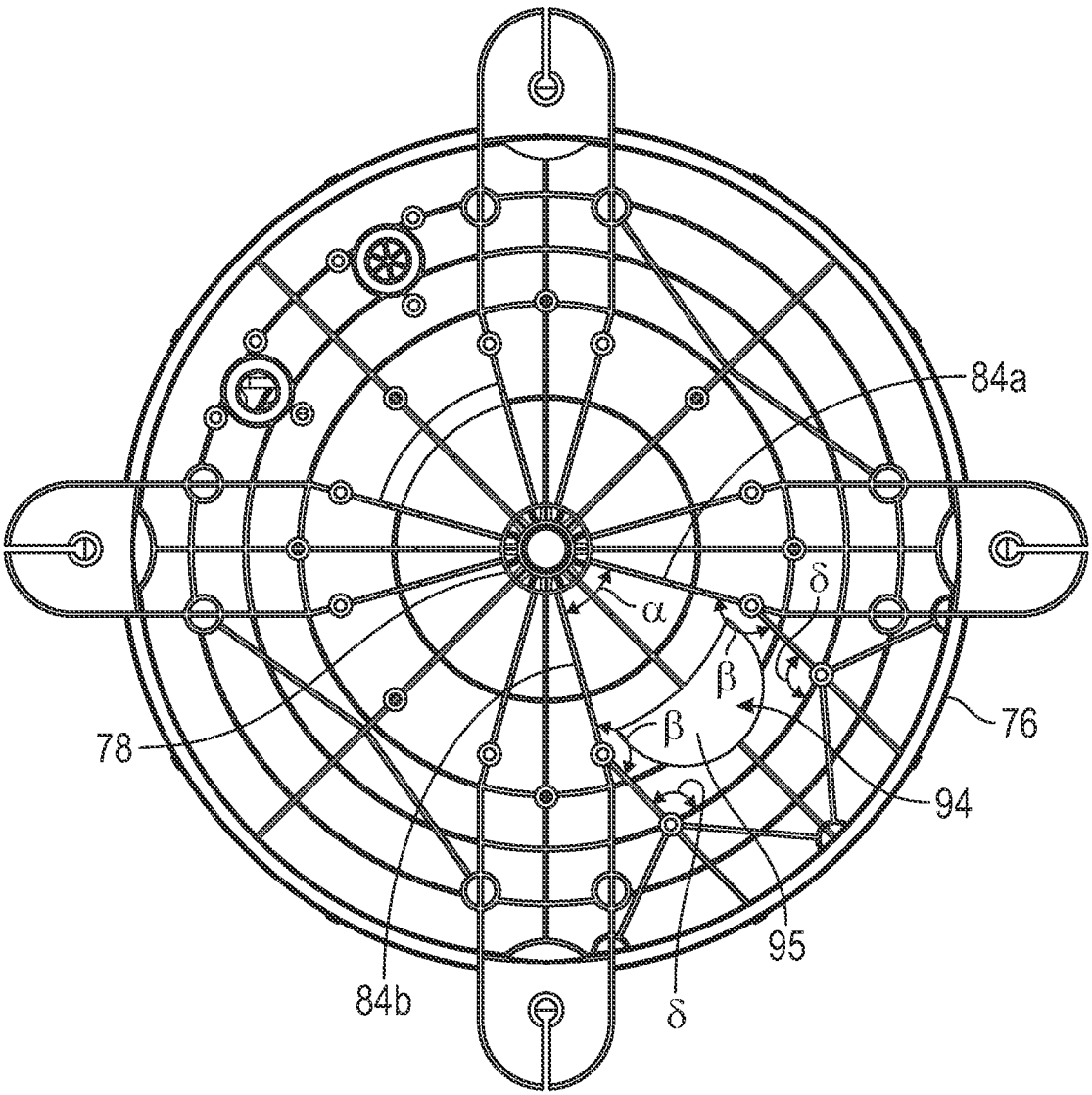
FIG. 3 is a bottom view of the tub of FIG. 2.
Figure 4:
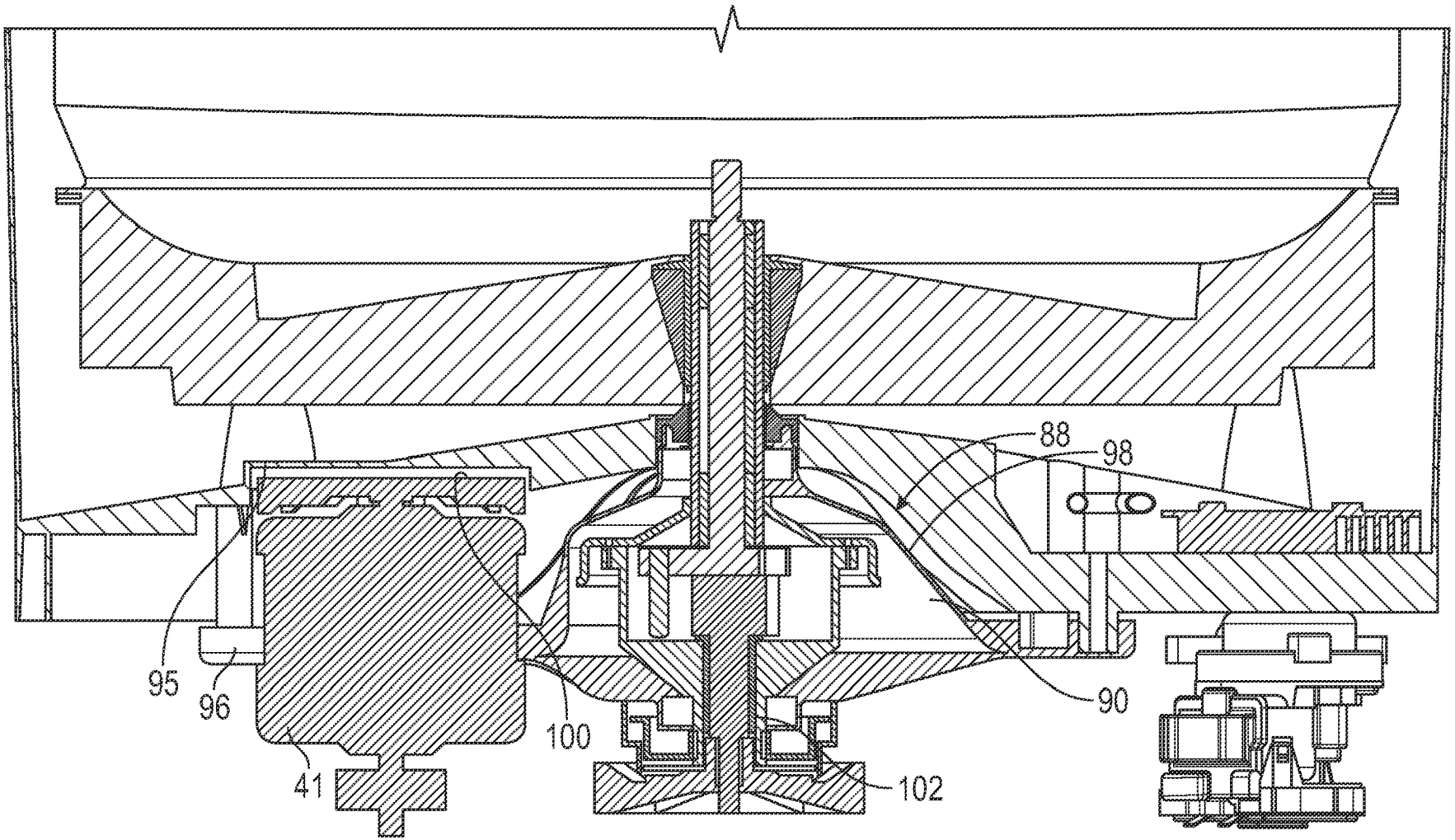
FIG. 4 is a side view of the tub, drive assembly and motor of the laundry treating appliance of FIG. 1.

Aspects of the disclosure relate to a laundry treating appliance that includes a basket having at least a portion which is imperforate. By way of overview, FIG. 1 is illustrative of an example of a laundry treating appliance in the form of a washing machine that includes a structural support system, drive system, liquid supply system, recirculation and drain system, and dispensing system. The structural support system can include a cabinet, tub, and basket rotatably mounted within the tub for receipt of laundry items. FIGS. 2 and 3 are illustrative of an exemplary tub of the present disclosure that can be utilized within the laundry treating appliance. The tub can include a rib support structure and a cavity that allows the motor to nest in the cavity of the tub. FIG. 4 is illustrative of various aspects of tub structure illustrating the compactness of the motor in the cavity, which allows for increased basket capacity while maintaining desired system stiffness.

In more detail, and referring again to FIG. 1, a schematic sectional view of a laundry treating appliance in the form of a washing machine 10 is illustrated according to one embodiment of the invention. While the laundry treating appliance is illustrated as a vertical axis, top-fill washing machine, the embodiments of the invention can have applicability in other fabric treating appliances, non-limiting examples of which include a combination washing machine and dryer, a refreshing/revitalizing machine, an extractor, or a non-aqueous washing apparatus.

The washing machine 10 can include a structural support system comprising a cabinet 14 that defines a housing, within which a laundry holding system resides. The cabinet 14 can be a housing having a chassis and/or a frame, to which decorative panels may or may not be mounted, defining an interior that receives components typically found in a conventional washing machine, such as motors, pumps, fluid lines, controls, sensors, transducers, and the like. Such components will not be described further herein except as necessary for a complete understanding of the invention.

A user interface 24 may be included on the cabinet 14 and may have one or more knobs, dials, switches, displays, touch screens and the like for communicating with the user, such as to receive input and provide output. The user can enter different types of information including, without limitation, cycle selection and cycle parameters, such as cycle options. A door or lid 28 may be operably coupled with the cabinet 14 and may be selectively moveable between opened and closed positions to close an opening in a top wall of the cabinet 14, which provides access to the interior of the cabinet 14.

The fabric holding system of the illustrated exemplary washing machine 10 can include a rotatable basket 30 having an open top that can be disposed within the interior of the cabinet 14 and may define a treating chamber 32 for receiving laundry items for treatment. The basket 30 can have a generally cylindrical side or tub peripheral wall 18 closed at its bottom end by a basket bottom wall 20 that can at least partially define a sump 60 and the treating chamber 32. An imperforate tub 34 can also be positioned within the cabinet 14 and can define an interior within which the basket 30 can be positioned.

The basket 30 can be rotatably mounted within the tub 34 for rotation about a vertical basket axis of rotation and can include a plurality of perforations, such that liquid may flow between the tub 34 and the rotatable basket 30 through the perforations.

A laundry mover 38 may be rotatably mounted within the basket 30 to impart mechanical agitation to a load of laundry placed in the basket 30. The laundry mover 38 can be oscillated or rotated about its vertical axis of rotation during a cycle of operation in order to produce load motion effective to wash the load contained within the treating chamber 32. Other exemplary types of laundry movers include, but are not limited to, an agitator, a wobble plate, and a hybrid impeller/agitator. The basket 30 and the laundry mover 38 may be driven by a drive assembly 90 that includes a motor 41 operably coupled with the basket 30 and laundry mover 38. The motor 41 can rotate the basket 30 at various speeds in either rotational direction about the vertical axis of rotation, including at a spin speed wherein a centrifugal force at the inner surface of the basket side wall 18 is 1 g or greater. Spin speeds are commonly known for use in extracting liquid from the laundry items in the basket 30, such as after a wash or rinse step in a treating cycle of operation. A loss motion device or clutch (not shown) can be included in the drive assembly 90 and can selectively operably couple the motor 41 with either the basket 30 and/or the laundry mover 38.

A liquid supply system can be provided to supply liquid, such as water or a combination of water and one or more wash aids, such as detergent, into the treating chamber 32. The liquid supply system can include a water supply configured to supply hot or cold water. The water supply can include a hot water inlet 45 and a cold water inlet 46, a valve assembly, which can include a hot water valve 48, a cold water valve 50, and a diverter valve 55, and various conduits 52, 56, 58. The valves 48, 50 are selectively openable to provide water, such as from a household water supply (not shown) to the conduit 52. The valves 48, 50 can be opened individually or together to provide a mix of hot and cold water at a selected temperature. While the valves 48, 50 and conduit 52 are illustrated exteriorly of the cabinet 14, it may be understood that these components can be internal to the cabinet 14.

As illustrated, a detergent dispenser 54 can be fluidly coupled with the conduit 52 through a diverter valve 55 and a first water conduit 56. The detergent dispenser 54 can include means for supplying or mixing detergent to or with water from the first water conduit 56 and can supply such treating liquid to the tub 34. It has been contemplated that water from the first water conduit 56 can also be supplied to the tub 34 through the detergent dispenser 54 without the addition of a detergent. A second water conduit, illustrated as a separate water inlet 58, can also be fluidly coupled with the conduit 52 through the diverter valve 55 such that water can be supplied directly to the treating chamber through the open top of the basket 30. Additionally, the liquid supply system can differ from the configuration shown, such as by inclusion of other valves, conduits, wash aid dispensers, heaters, sensors, such as water level sensors and temperature sensors, and the like, to control the flow of treating liquid through the washing machine 10 and for the introduction of more than one type of detergent/wash aid.

A liquid recirculation system can be provided for recirculating liquid from the tub 34 into the treating chamber 32. More specifically, a sump 60 can be located in the bottom of the tub 34 and the liquid recirculation system can be configured to recirculate treating liquid from the sump 60 onto the top of a laundry load located in the treating chamber 32. A pump 62 can be housed below the tub 34 and can have an inlet fluidly coupled with the sump 60 and an outlet configured to fluidly couple to either or both a household drain 64 or a recirculation conduit 66. In this configuration, the pump 62 can be used to drain or recirculate wash water in the sump 60. As illustrated, the recirculation conduit 66 can be fluidly coupled with the treating chamber 32 such that it supplies liquid into the open top of the basket 30. The liquid recirculation system can include other types of recirculation systems.

It is noted that the illustrated drive system, liquid supply system, recirculation and drain system, and dispensing system are shown for exemplary purposes only and are not limited to the systems shown in the drawings and described above. For example, the liquid supply, dispensing, and recirculation and pump systems can differ from the configuration shown in FIG. 1, such as by inclusion of other valves, conduits, treating chemistry dispensers, sensors (such as liquid level sensors and temperature sensors), and the like, to control the flow of liquid through the washing machine 10 and for the introduction of more than one type of treating chemistry. For example, the liquid supply system and/or the dispensing system can be configured to supply liquid into the interior of the tub 34 not occupied by the basket 30 such that liquid can be supplied directly to the tub 34 without having to travel through the basket 30. In another example, the liquid supply system can include a single valve for controlling the flow of water from the household water source. In another example, the recirculation and pump system can include two separate pumps for recirculation and draining, instead of the single pump as previously described.

The washing machine 10 can also be provided with a heating system (not shown) to heat liquid provided to the treating chamber 32. In one example, the heating system can include a heating element provided in the sump to heat liquid that collects in the sump. Alternatively, the heating system can be in the form of an in-line heater that heats the liquid as it flows through the liquid supply, dispensing and/or recirculation systems.

The washing machine 10 can further include a controller 70 coupled with various working components of the washing machine 10 to control the operation of the working components and to implement one or more treating cycles of operation. The controller 70 can include the machine controller and any additional controllers provided for controlling any of the components of the washing machine 10. For example, the controller 70 can include the machine controller and a motor controller. Many known types of controllers can be used for the controller 70. It is contemplated that the controller is a microprocessor-based controller that implements control software and sends/receives one or more electrical signals to/from each of the various working components to implement the control software. As an example, proportional control (P), proportional integral control (PI), and proportional derivative control (PD), or a combination thereof, a proportional integral derivative control (PID), can be used to control the various components of the washing machine 10.

Referring now to FIGS. 2 and 3, a lower region 35 of the tub 34 of the washing machine 10 is illustrated in further detail. The tub 34 can include a peripheral wall 36 extending from an upper region 37 to the lower region 35 and can define a tub interior 42, which surrounds and houses rotatable basket 30. It is contemplated that the tub 34, including the lower region 35 can be formed as a single, monolithic component, including by injection molding.

The lower region 35 of the tub 34 can include a solid hub structure 72 with a central hole 74. The central hole 74 is defined by a first circular rim 78. An outer circular rim 76 circumscribes the hub structure 72 and defines the lower outer surface of the tub 34. One or more circular rims 80 can be radially positioned between the first circular rim 78 and outer circular rim 76. One or more radial ribs 84 can be spaced about the circumference of the tub 34 and extend between the first circular rim 78 and the outer circular rim 76. The radial ribs 84 can be numbered, spaced, sized, and shaped to provide the desired stiffness of the tub 34.

In an exemplary embodiment, the radial ribs 84 extend from the central rim 76 and can transition to an arcuate surface 86. The arcuate surfaces 86 of the radial ribs 84 collectively define a central cavity 88 (as best seen in FIG. 4) for housing a drive assembly 90. The drive assembly 90 can be configured to nest in the central cavity 88. From the arcuate surface 86, the radial ribs 84 extend outwardly toward the outer circular rim 76. At portions along the radial ribs 84, each rib 84 can be configured with varies stiffeners or attachment elements 92 to create stiffness and structure in the tub 34. The attachment elements 92 can be provided to allow attachment of the drive assemble 90 to the tub 34.

The radial ribs 84 can be spaced and angled in such a way so as to define a second cavity 94 configured to house motor 41. The second cavity 94 is spaced from the central cavity 88. In an exemplary arrangement of radial ribs 84, the second cavity 94 can be defined by radial ribs 84*a* and 84*b* and by tub surface 95. Radial ribs 84*a* and 84*b* can extend from the first circular rim 78 at an angle α until the distance between the ribs 84*a, b* is greater than the diameter of the motor 41. Each rib 84*a, b* can then transition at angle β, and again at angle δ, to form a six sided polygon support structure around the motor 41, where the ribs 84*a, b* extend to the second circular rim 76. The various angles that define the trajectory of radial ribs 84*a, b* are to provide stiffness and structure to the tub 34 as the motor 41 is housed and nested in the second cavity 94. Tub lower surface 95 can be notched or profiled to accommodate motor 41. As illustrated, the tub lower surface 95 is a generally flat, half mooned shape notched into the surface or ribs of the tub 34. By allowing the motor 41 to at least partially, if not mostly nest in the second cavity 94, the stack of the combined motor 41 and tub 34 can be reduced to provide more vertical space in the machine 10. Providing more vertical space in the machine 10 can be used to optimize cost, capacity, or spin speed, such as, but not limited to, increasing the size/space of the wash basket 30. In an exemplary embodiment, at least half the motor 41 is nested in the second cavity 94 in tub 34.

FIG. 4 illustrates the compactness of the tub 34, drive assembly 90 and motor 41 according to the present disclosure which allows for an extended tub length. As illustrated, the drive assembly 90 can comprise a transmission 102 and a drive plate 96 and can be configured to nest in the central cavity 88. The drive plate 96 can attach to the bottom of the tub 34 at attachment elements 92. The drive plate 96 can be used to mount the drive assembly 90 and the motor 41 to the tub 34. The drive assembly 90 can have an outer profile shape 98 complimentary to the arcuate surfaces 86 of the radial ribs 84 to allow the drive assembly 90 to tightly fit in the central cavity 88. In other words, there is little clearance, if any, between the drive plate 96 and the radial ribs 84 of the lower region tub 35 structure. Similarly, the motor 41 can have a surface 100 complimentary in shape to the tub surface 95 to allow the motor 41 to tightly fit or nest in the tub 34. The motor 41 is thereby allowed to pushed up into the tub 34 to be as close to the underside of the basket 30 as possible, which still providing proper tub clearance.

Aspects of the present disclosure can provide for a variety of benefits. It can be appreciated that existing vertical axis laundry machines have discrete structural elements such as a wash basket, tub, drive system and motor that when combined together create a system that has a combined stiffness that is a function of the stiffness of each of the elements. If any one of these elements does not have comparable stiffness it becomes the weakest link, and it dominates the stiffness of the entire structure. This means that each element has to contribute in a comparable fashion to the stiffness of the complete assembly. One benefit of the present disclosure is a product architecture that allows the motor and drive assembly to be nested up into the bottom of the tub without compromising the stiffness of either the tub or the drive. This can be accomplished by extending the structure on the bottom of the tub such as its ribs down to the lower drive plate and attaching the drive to the tub at this point instead of attaching it to the top drive plate as is typical in the state of the art. By nesting the motor and drive into the tub, the vertical stack of the tub and motor can be reduced. This means that there is additional spaced in the machine, and that space can be used to optimize cost, capacity, or spin speed.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention, which is defined in the appended claims.

The invention claimed is:

1. A laundry treating appliance comprising:

a rotatable basket defining a treating chamber;

a tub for mounting the rotatable basket;

a drive assembly mounted to the tub for rotating the basket;

a drive motor mounted to the tub for driving the drive assembly;

the tub comprising a lower region comprising a non-symmetrical plurality of circular rims and radial ribs defining a central cavity about a first circular rim and a second cavity spaced from the central cavity; at least two of the plurality of radial ribs extending from the first circular rim at an acute first angle until a distance between the at least two of the plurality of radial ribs is greater than a diameter of the drive motor, wherein the first angle is between the at least two of the plurality of radial ribs, each of the at least two of the plurality of radial ribs then transitioning at an obtuse second angle for a length to accommodate the diameter of the drive motor, and each of the at least two of the plurality of radial ribs then further transitioning at an obtuse third angle for a length to form the second cavity around the drive motor; and wherein the drive assembly is nested in the central cavity and the drive motor is nested adjacent the second cavity such that at least a portion of a height of the at least one of the plurality of circular rims extends a length of the drive motor for reducing a vertical stack of the tub and the motor.

2. The laundry appliance of claim 1, further comprising a third radial rib extending between the at least two of the plurality of radial ribs.

3. The laundry treating appliance of claim 2, wherein the third radial rib extends between the first circular rim and an outer rim.

4. The laundry treating appliance of claim 3, wherein the at least one of the plurality of circular rims and the third radial rib is notched to define a flat lower surface of the second cavity.

5. The laundry treating appliance of claim 4, wherein the drive motor is nested adjacent the flat lower surface.

6. The laundry treating appliance of claim 1, wherein the second cavity formed around the motor is a six-sided polygon.

7. The laundry treating appliance of claim 1, wherein at least one of the plurality of radial ribs has an arcuate surface that defines a bottom of the at least one of the plurality of radial ribs.

8. The laundry treating appliance of claim 7, wherein the drive assembly has an outer profile that is shaped complimentary to the arcuate surface.

9. The laundry treating appliance of claim 1, wherein the drive assembly further comprises a drive plate for mounting the drive assembly and motor to the tub.

10. The laundry treating appliance of claim 9, wherein at least one of the plurality of radial ribs extends to the drive plate on the drive assembly.

11. The laundry treating appliance of claim 10, wherein at least one of the plurality of radial ribs further comprises at least one attachment element for attaching the drive plate to the tub.

12. The laundry treating appliance of claim 4, wherein the motor comprises a flat surface complimentary to the flat lower surface of the second cavity for allowing at least a portion of the motor to nest in the tub.

13. The laundry treating appliance of claim 12 wherein at least half of the motor is nested in the tub.

14. The laundry treating appliance of claim 1 wherein the tub is formed as a single monolithic component.

15. The laundry treating appliance of claim 1 wherein each of the at least two of the plurality of radial ribs is a mirror image of one another.

16. The laundry treating appliance of claim 1 further comprising at least one straight radial rib extending between the first circular rim and an outer rim.

17. The laundry treating appliance of claim 16, wherein the at least one straight radial rib and the at least two of the plurality of radial ribs are non-symmetrical.

* * * * *